United States Patent [19]

Andrews

[11] 4,456,244

[45] Jun. 26, 1984

[54] SWING PROPELLING FOOT REST

[76] Inventor: Richard L. Andrews, 4338 Capitol Ave., Macon, Ga. 31206

[21] Appl. No.: 356,938

[22] Filed: Mar. 10, 1982

Related U.S. Application Data

[63] Continuation-in-part of Ser. No. 195,373, Dec. 31, 1980, abandoned.

[51] Int. Cl.[3] ..... A63G 9/16

[52] U.S. Cl. ..... 272/92; 297/433; 297/273

[58] Field of Search ..... 297/273–282, 297/433, 434, 77; 272/85–92; D21/246

[56] References Cited

U.S. PATENT DOCUMENTS

| | | | |
|---|---|---|---|
| 302,164 | 7/1884 | Schenck | 272/92 |
| 330,306 | 11/1885 | Fellows | 272/92 |
| 586,432 | 7/1897 | Gower | 297/433 |
| 639,076 | 12/1899 | May | 297/433 |
| 886,974 | 5/1908 | Hathaway | 297/273 |
| 1,013,956 | 1/1912 | Sanders | 297/278 |
| 1,107,341 | 8/1914 | Oldfield | 297/273 |
| 1,259,061 | 3/1918 | Whetstone | 297/273 |

*Primary Examiner*—Richard J. Apley
*Assistant Examiner*—S. R. Crow
*Attorney, Agent, or Firm*—V. L. Leon; Harry I. Leon

[57] ABSTRACT

An attachment for use with common porch swings and the like which includes a foldable platform that not only serves as a foot rest but also provides means by which a rider can, with a small amount of effort, propel the swing from rest to a gentle swinging motion. In addition to the platform, the attachment comprises a supporting structure and a pair of flexible members from which portions of the platform proximate its rear and front edges, respectively, are suspended when the platform is fully extended.

The attachment transforms foot pressure as it is being applied to straighten the platform for use as a foot rest into a force tending to propel the swing forward. Only a slight pressure is required to set the swing in motion. The action of unfolding the platform is coupled with an increase in tension on the flexible members supporting the platform to greatly magnify the non-vertical component of the force supplied by the rider's foot on the platform. As long as foot pressure is applied during the forward motion of the swing, the swinging motion will be increased. Alternately, pressure may be applied during the backward motion of the swing to brake its movement.

The attachment also includes a spring which acts to fold the platform upwardly, readying it for the next application of foot pressure. In the absence of any further such pressure, this spring draws the platform into a retracted position beneath the swing seat and out of the way of a rider attempting to mount or dismount the swing.

15 Claims, 6 Drawing Figures

SWING PROPELLING FOOT REST

CROSS-REFERENCES TO RELATED APPLICATIONS

This application is a continuation-in-part of my earlier copending application, Ser. No. 195,373, filed Dec. 31, 1980 now abandoned.

BACKGROUND OF THE INVENTION

1. Field of the Invention

This invention relates to the field of lawn, patio, and porch swings and particularly to that segment relating to foot rest platforms which are movable with respect to the body of such swings.

2. Description of the Prior Art

Apparatus having foot rest platforms which are movable with respect to the swing bodies to which they are connected have already been described in the patent literature. Typically, the motion of a rider's legs transferred through the pressure of his feet on the platform provides some propulsion to the swing.

In U.S. Pat. No. 1,406,529, a foot rest platform is mounted on linkage secured to the underside of a swing and extends outwardly in front of it. A person, preparing to enter the swing, must place one foot upon the platform to lower it so that he can be seated. The requirement of having to step onto a moving platform to sit upon the swing makes its use hazardous for many. Moreover, a large amount of effort must be expended with this combination to obtain a relatively small change in swinging motion.

U.S. Pat. Nos. 1,783,502 and 1,944,445 each describe a foot rest platform mounted on a pair of arms which are pivotally connected to the front of the swing body. The arms act upon the front pair of chains supporting the swing, pulling them forward and lifting the front edge of the swing when the operator presses down and back on the platform. Most riders, accustomed as they are to raising their legs during the forward movement of a swing in order to increase its arc find this motion of instead pressing downwardly and rearwardly in order to affect a similar response most unnatural. As a consequence, starting such a swing from a static position is awkward at best. U.S. Pat. No. 1,944,445 even suggests that the swing is decidedly inconvenient to move from a resting position by a rider's exerting pressure on the platform alone. This patent, in fact, teaches that after a person is seated in the swing, he may conveniently start it by pushing his feet against the floor. A push off is thus recommended to initiate swinging. The swing, once started, can be kept in motion with the use of the platform; but the movements required of a rider to utilize it are unnatural.

To facilitate starting the swing by the operator's pushing his feet against the floor, a foot rest platform retracting mechanism can be employed as taught in U.S. Pat. No. 1,944,445. Each of the two arms on which the platform is mounted are formed in two sections; these two sections share a common pivot which extends laterally from the front of the swing on either side. They become interlocked when a pin on one of them moves into a slot in the other as foot pressure is applied to the platform. Each slot and the pin retained therein disengage under the force of a spring when the operator lifts his feet; simultaneously, the lower sections of the two arms swing upwardly about their pivots under the weight of the platform. To prevent the retracted platform from extending too far in front of the swing and striking the legs of a user who may be trying to push his feet against the floor or to disembark, a truncated platform must be employed making it a less than optimum foot rest.

An alternate means of propelling a swing by foot action is disclosed in U.S. Pat. No. 2,900,010. The swing seat is supported by the top frame member of a set of four rigid frame members which are hingedly interconnected to form an upright parallelogram. The seat which is slidable along the top frame member moves as it is tilted fore and aft by the force of the rider's arms and legs applied to the upright front frame member. As the center of gravity of rider and swing shift, a swinging motion is obtained. This apparatus, however, is made for a single individual who is either very agile or of sufficiently light weight that he can be placed astride the seat; and as a consequence, it is not suitable for use by the elderly. Moreover, a considerable amount of force must be applied by the rider if the swing is to obtain a large arc, making it especially useful for its advertised use, i.e., therapeutic exercising.

Apparatus having a foot rest bar or platform which is pivotally connected to a swing body but which is not intended to be useable for any propelling of the swing are disclosed in U.S. Pat. Nos. 2,710,650 and 1,259,061. A raised back section on the foot rest platform disclosed in the latter patent, in fact, would inhibit a rider's efforts to propel the swing by preventing him from working his legs beneath the seat to shift the center of gravity of his body and the swing. Further, any opening behind the platform into which one might step to facilitate mounting the swing or pushing one's feet against the ground has been eliminated. The swing is suitable only for small children who can be placed on its seat.

In U.S. Pat. No. 3,765,674, a foot rest bar of narrow width is employed so that the user can step through an opening behind it. The foot rest bar is mounted on long, immovable rails which extend outwardly beneath the swing in either direction. For the most part, the motion of the rails and swing must be restricted to a gliding one, parallel to the earth's surface. By providing springs between disparate links in the cables for suspending the swing and by attaching them to the rails, some tilting of the swing as a rider shifts his weight is obtained. But the foot rest bar is not useable for any propelling of the swing. Rather a swing occupant by bearing down on this bar during forward motion of the swing causes the front of it to tilt downwardly giving himself a bouncing ride.

SUMMARY OF THE INVENTION

In accordance with the present invention, there is provided an apparatus attachable to lawn, patio, and porch swings which has a foot rest platform to which a rider need only apply a slight foot pressure to set the swing in motion. No contact between the operator's feet and the ground is required to initiate swinging motion.

The apparatus comprises a folding member having the foot rest platform and a pair of arms in which opposite end portions of each arm are pivotally connected to the platform and to a rigid support member which is mounted and projects downwardly from one of the swing arm rests. The folding member is subject to a biasing means which causes the outer ends of the arms to rotate upwardly, simultaneously elevating the rear of the platform. Under the force of the biasing means, the platform and the arms automatically fold together, when no foot pressure is applied to the platform, out of the way of a rider's path for mounting and dismounting the swing seat. In this retracted position, the only supports of the platform are the two arms to which it is pivotally connected and the biasing means. An additional supporting means comprising a pair of flexible members which are connected to the front portion of the platform is deployed as the platform is being extended. The length of each flexible member is such that it is slack when the platform is in its retracted position and is stretched taut before the platform reaches its full foward travel, so that the application of foot pressure to the platform can easily set the swing, initially at rest, in motion.

The platform further includes limit stops which abut sections of the arms pivotally connected thereto when both they and the platform are fully extended. With the span provided by the arms, the platform is disposed at an ample distance in front of the swing to serve as a comfortable foot rest. The arms and the platform move as a unit, when sufficient foot pressure is applied to the platform to overcome the biasing means, about the pivotal joints between the arms and the support members.

In the fully extended position of the platform then, the pair of flexible members connected thereto and the two rigid support members to which the arms are pivotally joined comprise means for suspending the folding member in tandem with the swing. The flexible members are attached to an overhead structure at points which are disposed substantially in front of those to which the chains supporting the swing itself are secured. By positioning the points of attachment of the flexible members so that each of these members is disposed approximately parallel to a line connecting the point of attachment of the swing chain and the pivotal joint between the folding arm and the support member on the same side of the swing, the upper surface of the folding member, including that of the foot rest platform, remains inclined at approximately the same angle to the horizon as the swing traverses its arc. Simultaneously, the swing seat tilts first upwardly and then downwardly as the swing moves fore and aft, respectively. The motion of the folding member can be adjusted to one that is intermediate between that in which its upper surface is maintained at an approximately constant slope and that in which it is tilted fore and aft like the swing seat. This intermediate motion is obtained by positioning the points of attachment of the flexible members closer to those of the swing supporting chains.

As the swing moves backwardly along its arc, the rider's body is tilted forwardly, pivoting slightly about his ankles. With respect to the plane of the swing seat, the rider's feet are in effect rotated upwardly preparatory to the application of pressure on the platform during forward movement of the swing. The platform thus works with an operator's natural leg action. The application of a noticeable but slight pressure on the platform during a forward stroke of the swing is sufficient to increase its arc. Once the arc is adequate, the amount of pressure required to keep the swing in motion is so little that swinging appears effortless.

A further object is to make the use of lawn, patio, and porch swings more pleasurable for the elderly and others who find a swing seat which is low enough so that they can push their feet against the ground from a sitting position too low for them to mount and dismount comfortably. Above a minimum distance required to allow clearance between the support members and the ground, a swing equipped with the apparatus according to the present invention can be adjusted to accomodate the preference of an individual user. Further, this height can be such that the killing of the grass and the formation of ruts beneath the path of a lawn swing are eliminated.

A still further object is to provide an apparatus which is adaptable to existing lawn, patio, and porch swings and which can be attached thereto by the use of commonly available home workshop tools.

BRIEF DESCRIPTION OF THE DRAWINGS

Further details are explained below with the help of the examples illustrated in the attached drawings in which.

Like reference characters indicate corresponding parts throughout the several views of the drawings.

DESCRIPTION OF THE PREFERRED EMBODIMENT

Figure 1:
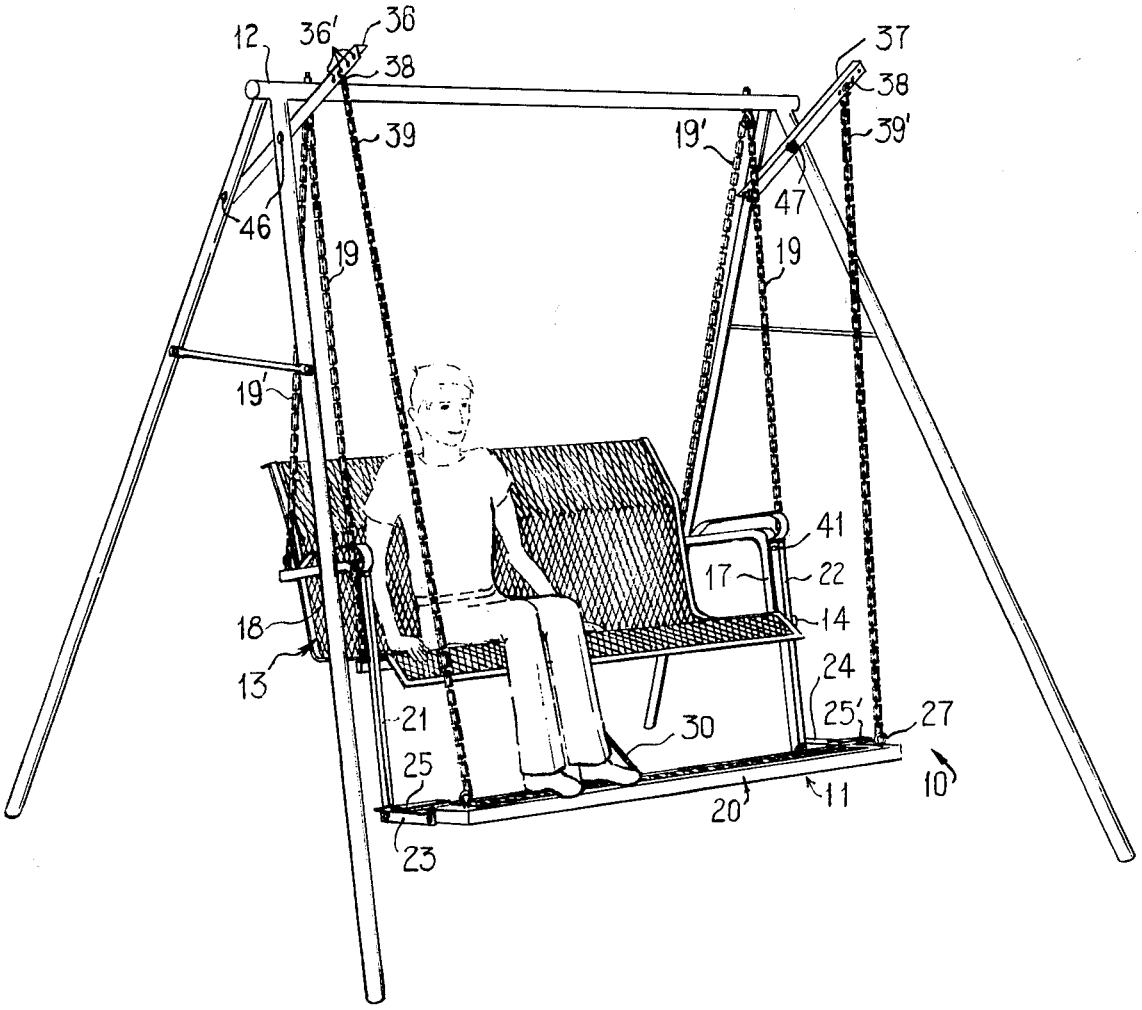
FIG. 1 is a front perspective view of one embodiment of the present invention in which the apparatus including the foot rest platform is attached to a swing and to a free-standing frame from which it is suspended; a person is shown seated on the swing with his feet resting on the platform in its fully extended position.

In the drawings, an apparatus 10 incorporating the present invention is shown connected to a swing 13 and an overhead structure from which it is suspended such as a free-standing frame 12. The swing 13 is carried at its front side by a pair of chains 19 and at its rear side by a pair of chains 19'. The uppermost links of each front chain 19 and the rear chain 19' attached to the same end of the swing 13 are connected side by side to a common eye bolt or the like.

Figure 2:
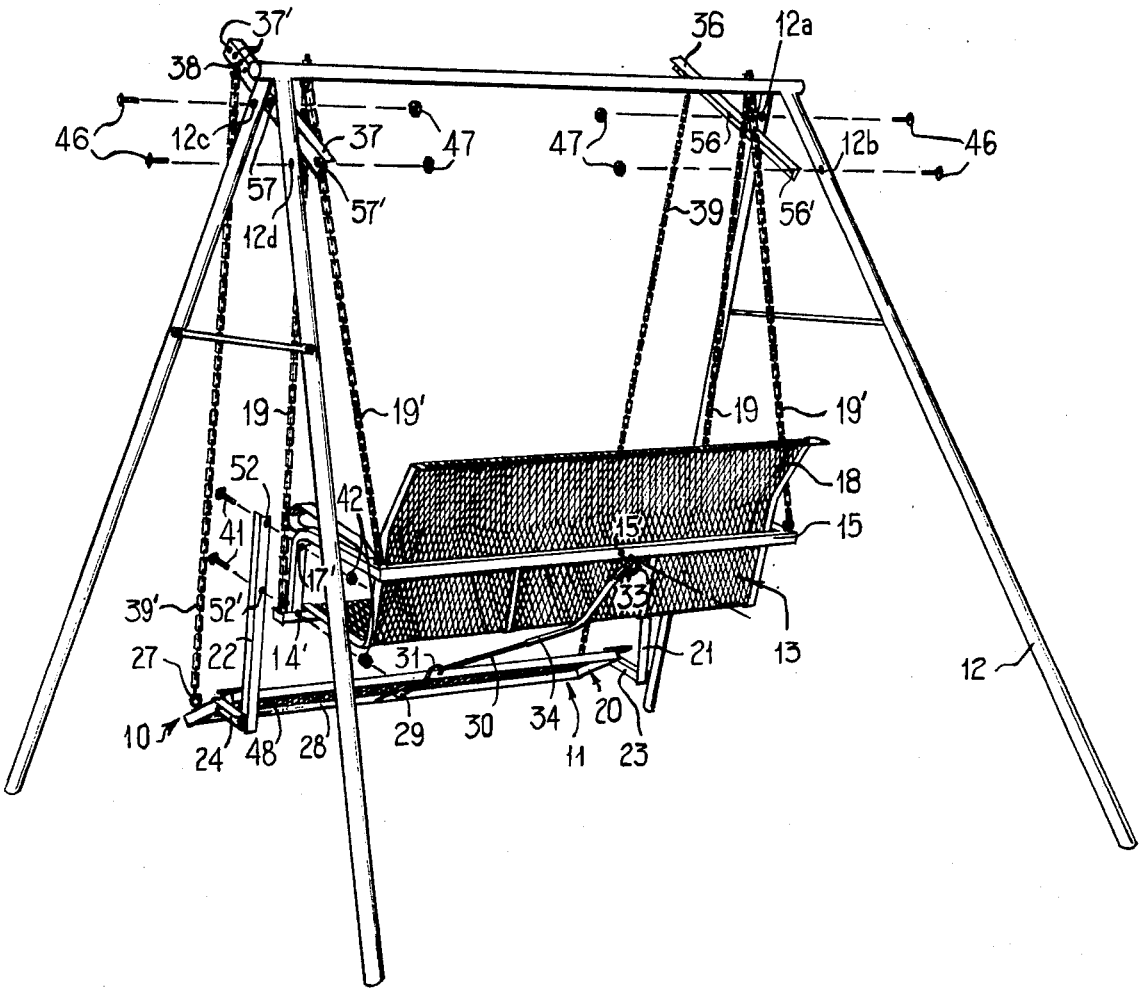
FIG. 2 is an exploded view showing in perspective the apparatus and the swing shown in assembled form in FIG. 1, the platform being in a partially extended position.

As is shown in FIGS. 1–2, the apparatus 10 preferably comprises a pair of flexible members such as the chains 39, 39'; a folding member 11 having a foot rest platform 20 with eye bolts 27 to which the lower links of the chains 39, 39' are connected; and a means for suspending the flexible members including the mounting bars 36, 37. Alternately, the flexible members may be formed of steel cable or rope. Folding arms 23, 24 which are in the member 11 are pivotally connected to a pair of rigid supports 21, 22 (FIG. 2). The supports 21, 22 are secured to the swing 13 by any appropriate mechanical fasteners such as the bolts 41 and the nuts 42.

Alternately, the supports 21, 22 can be welded to the frame of the swing 13.

As is seen in FIG. 2, the swing 13, which is otherwise of standard type, has two sets of holes 14', 17' for receiving the bolts 42 and a hole 15' for securing the the hook 33 which is attached to the spring 30. Further description of the spring 30 and its function is provided hereinbelow. For the swing 13 illustrated in the drawings, the holes 14', 17' are formed in the cross bar 14 which supports the swing seat and in the forward section of each of the swing arm rests, respectively. The nuts 42 are used to hold the bolts 41, the supports 21, 22, and the swing 13 in assembled relation. To mount the supports 21, 22 on a swing model other than that illustrated, the upper portion of each support may need to be modified. In one such alternate embodiment (not shown), the upper portion of each support is disposed at an obtuse angle to the portion thereof which projects downwardly from the swing seat.

Figure 5:
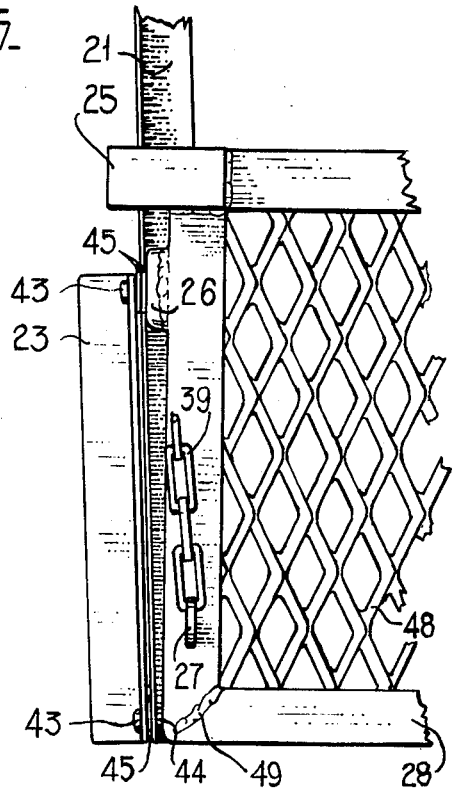
FIG. 5 is a further enlarged elevational view of a fragmentary portion of the foot rest platform and of an arm supporting it, showing the platform in a fully retracted position.

The platform 20 comprises an elongated, rectangular frame 28 formed of a suitable material such as steel, aluminum, or wood. In the preferred embodiment seen in FIGS. 4 and 5, the platform 20 includes angle steel bars welded together as at 49 and a net 48 preferably formed of an expanded steel mesh which is spot welded to the underside of the frame 28. Spacers 26 are welded to the outer sides of the platform 20 (FIG. 5). The spacers 26 are preferably formed of 3/16 inch thick steel which may, by way of example, measure 1 inch square. Each spacer 26 is separated by a short distance from the corner section of the platform 20 over which a limit stop 25, 25' extends. The spacers 26 are provided to prevent binding between the arms 23, 24 and the sides of the platform 20 when it is fully retracted (FIG. 5).

Figure 3:
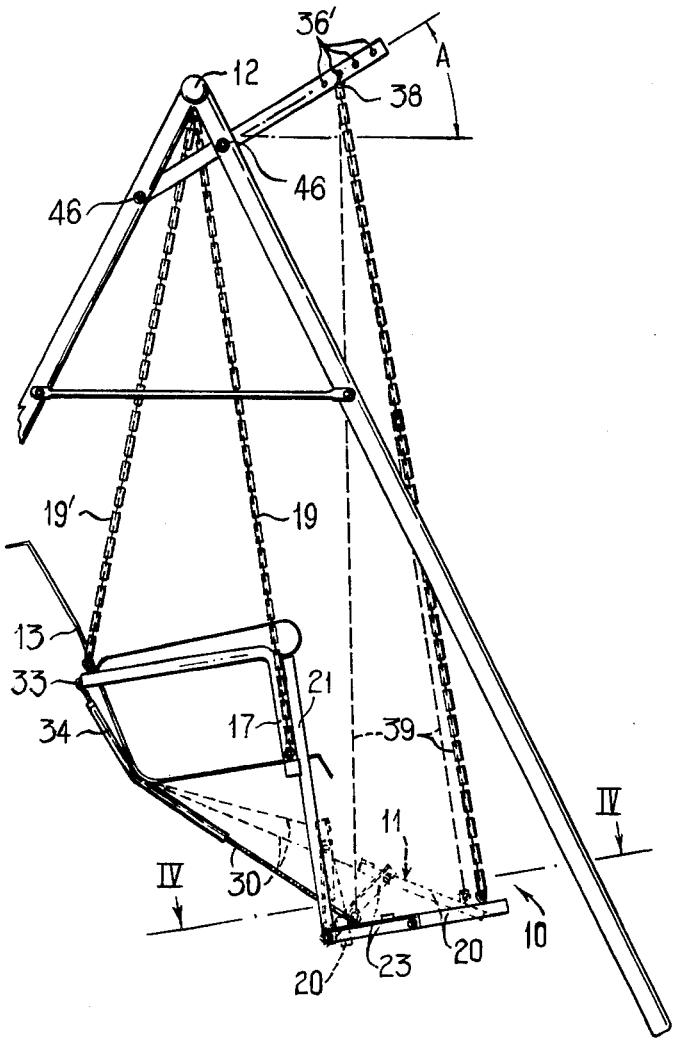
FIG. 3 is a side elevational view of the embodiment of the invention shown in FIG. 1, two alternate positions of the platform being superimposed as dashed lines.
Figure 4:
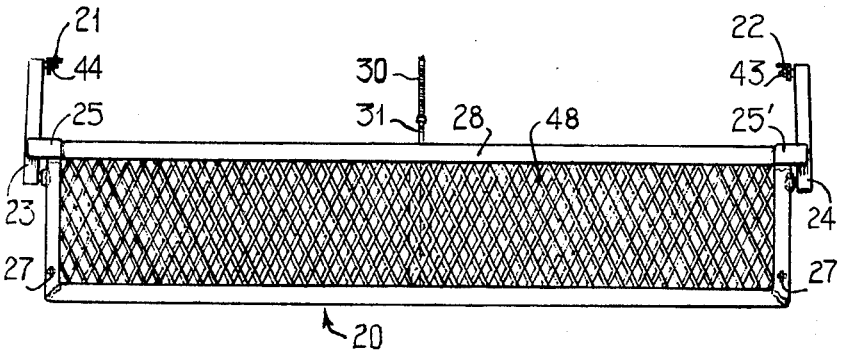
FIG. 4 is an enlarged cross-sectional view taken on line IV—IV of FIG. 3.

The pair of folding arms 23, 24 which are preferably formed of angle steel bars or the like and which have end portions disposed contiguous to the spacers 26 are pivotally connected to the platform 20 (FIGS. 3–5). Each such end portion is separated from the proximate outer sides of the platform 20 by one of the spacers 26 and by two washers 45. The opposite end portion of each arm 23, 24 is pivotally connected to one of the supports 21, 22 and is separated therefrom by a washer 45. Holes are formed in the distal end portions of each arm 23, 24; the washers 45; the spacers 26; the sections of the frame 28 contiguous the spacers 26; and the supports 21, 22 for receiving the bolts 43. The nuts 44 hold the bolts 43, the arms 23, 24, washers 45, and the platform 20 in assembled relation. Similarly, the nuts 44 hold the bolts 43, the arms 23, 24, washers 45, and the supports 21, 22 in assembled relation. Each nut 44 is preferably a self-locking one such as a castle nut. Alternately, a second nut (not shown) may be threaded onto each bolt 43 adjacent the nut 44 to lock it in place. Some play in the pivotal joints between the arms 23, 24 and the platform 20 and between the arms 23, 24 and the supports 21, 22, respectively, is required to allow for ease in folding.

Figure 6:
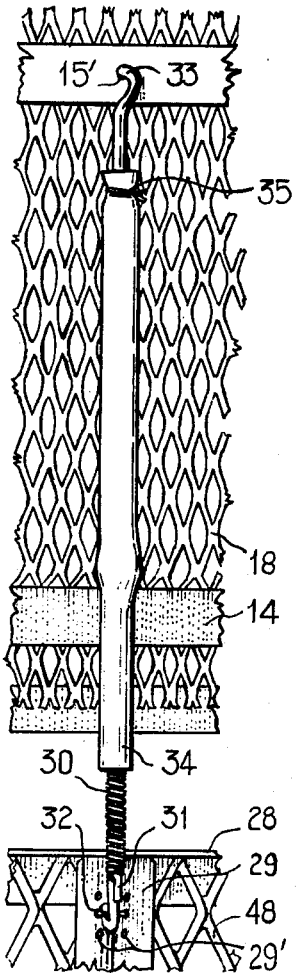
FIG. 6 is an enlarged elevational view on the scale of FIG. 5 of a fragmentary portion of the platform, which is shown in its fully retracted position, and of the spring connecting the platform to the rear of the swing seat.

As is shown in FIGS. 2, 3, and 6, a means for biasing the outer ends of the arms 23, 24 to rotate upwardly about their pivotal joints with the support members 21, 22 comprises a coil spring 30. Subjected to the force of the spring 30, the platform 20 and the arms 23, 24 automatically fold together, when no foot pressure is applied to the platform, against the supports 21, 22. As is illustrated by the upper set of dashed lines in FIG. 3, the platform 20 comes to rest in a retracted position beneath the front of the swing 13 and out of the way of a person mounting or dismounting the swing seat.

The spring 30 links a portion of the platform frame 28 which is proximate the rear edge thereof and the cross bar 15 which supports the back of the swing seat. A section of the spring 30 which stretches across the posterior surface of the swing seat is encased in a flexible sheath 34 which may be formed of rubber tubing or the like to prevent the spring 30 from rubbing against the swing 13. The upper end of the sheath 34 is secured to the spring 30 by any appropriate fastener such as the wire 35. The spring 30 itself is attached at both ends to hooks 31, 33. The hole 15' in the cross bar 15 is formed for receiving the upper hook 33; a loop formed in the lower hook is held by a pin 32 secured to a brace 29 (FIG. 6). The intersecting sides of the brace 29 which is preferably formed of an angle steel bar welded to the frame 28 are inclined at approximately 45° to the surface of the mesh 48. Several pairs of holes 29' are provided in the sloping sides of the brace 29 so that the position of the pin 32 may be changed to adjust the tension on the spring 30 so that it is just able to retract the platform 20. Except when the swing is moving along the higher regions of a large arc, only a slight foot pressure is sufficient to overcome the biasing means and maintain the platform 20 in its fully extended position. The more forwardly disposed pairs of holes 29' are employed to increase the tension on the spring 30; these holes are particularly useful for the wider, heavier foot rest platforms employed with the largest swings. Once the pair of holes 29' has been selected, the ends of the pin 32 may be bent to retain it within these holes.

In its retracted position, the only supports of the platform 20 are the two arms 21, 22 and the coil 30. An additional supporting means comprising the pair of chains 39, 39' is activated as the platform 20 is being extended. The length of each chain 39, 39' is such that it hangs slack when the platform 20 is retracted. Before it can be fully extended, however, the chains 39, 39' are stretched taut. If an operator continues to apply foot pressure to the platform 20 when this condition is met, the swing 13 will move forwardly and upwardly as the rider shifts the center of gravity of his body and the swing by extending his legs to force the platform outwardly against the chains 39, 39', in effect shortening them, and simultaneously increasing the tension on the spring 30 to pull the swing seat.

The platform 20 further comprises a pair of limit stops 25, 25' which abut sections of the arms 23, 24 when they and the platform 20 are fully extended. These sections of the arms 23, 24 are disposed generally perpendicularly to the portion of each arm in which the holes for the pivotal joints between it and the platform 20 and between it and one of the supports 21, 22 are formed. In the preferred embodiment shown in FIGS. 4 and 5, the limit stops 25, 25' which are rigidly attached to the upper surface of the frame 20 and extend outwardly from its two rear corners are formed of steel or a like material and welded to the frame 28. With the extra span provided by the arms 23, 24 when the upper sections thereof abut against the limit stops 25, 25', the platform 20 is disposed at an ample distance in front of the swing 13 to serve as a comfortable foot rest. The shortest distance between the front edge of the platform 20 and a support 21, 22 is, by way of example, approximately 15 inches.

In the fully extended position of the platform 20, the pair of chains 39, 39' connected thereto and the support members 21, 22 pivotally joined to the arms 23, 24 comprise means for suspending the folding member 11 in tandem with the swing 13. The chains 39, 39' are attached to mounting bars 36, 37, respectively at points which are disposed substantially in front of those to which the chains 19 supporting the swing 13 itself are secured. In the preferred embodiment shown in FIGS. 1–3, the mounting bars 36, 37 are secured to the legs of the frame 12 by any appropriate mechanical fasteners such as the bolts 46 and nuts 47. Alternately, the bars 36, 37 may be secured to a porch ceiling (not shown). Holes 56, 56'; 57, 57' which are provided in the bars 36, 37 are paired with holes **12*a*, 12*b*, 12*c*, 12*d*, respectively, formed in the frame 12 for receiving the bolts 46. These holes in the frame 12 can be made using commonly available tools. The nuts 47 are used to hold the bolts 46, the bars 36, 37, and the frame 12 in assembled relation. Each of the bars 36, 37 extends upwardly at an angle, shown as A in FIG. 3, of approximately 30° from the horizontal; with this angle, the projecting ends of the bars 36, 37** are disposed above the heads of most people.

Any appropriate detachable fastener such as an "S" hook 38 or an end link may be utilized to connect the upper link of each chain 39, 39' to the bar 36, 37, respectively. A segment of each "S" hook 38 is disposed within one of the plurality of holes 36', 37' formed in the bars 36, 37. As is seen most clearly in FIG. 3, the hole 36' employed to secure the hook 38 to the bar 36 is substantiallly centered above the pivot between the arm 23 and the support 21. Similarly, the point of attachment of the hook 38 to the bar 37 is substantially centered above the pivot between the arm 24 and the support 22. In such a position, the chains 39, 39' hang slack, thereby minimizing any force component from the chains 39, 39' opposed to the spring 30, when the platform 20 is fully retracted.

Further, the position of the points of attachment of the chains 39,39' to the bars 36, 37 determine the rate of change of the angle between the top surface of the platform 20 and the seat of the swing 13 as it traverses an arc. If the points of attachment of the chains 39, 39' are situated so that each chain 39, 39' is disposed approximately parallel to a line connecting the point of attachment of the swing chain 19 and the pivotal joint between the arm 23, 24 and the support member 21, 22 on the same side of the swing 13, the upper surface of the folding member 11, including that of the platform 20, remains, when fully extended, inclined at approximately the same angle to the horizontal throughout the arc of the swing 13. Simultaneously, the swing pivots about the joints between the support members 21, 22 and the arms 23, 24; the swing seat tilts first upwardly and then downwardly as the swing 13 moves fore and aft, respectively. By positioning the points of attachment of the chains 39, 39' closer to those of the swing chains 19, 19', the motion of the folding member 11 can be adjusted to one that is intermediate between that in which its upper surface is maintained at an approximately constant slope and that in which it is tilted fore and aft as the swing seat is. A rider notices that the platform 20 seems to ride up on a forward stroke of the swing 13 and to drop backwardly on a reverse stroke if the chains 39, 39' are attached too close to the swing chains 19, 19'. Similarly, if the chains 39, 39' are attached too far forward, the platform 20 seems to drop on a forward stroke and ride up on a reverse stroke.

When the chains 39, 39' are attached to the proper holes 36', 37' in the bars 36, 37, each application of a slight pressure to the fully extended platform 20 during forward movement of the swing 13 increases its arc. As the swing 13 moves backwardly along its arc, the rider's body is tilted forwardly, pivoting slightly about his ankles. With respect to the plane of the swing seat, the rider's feet are in effect rotated into position to apply pressure on the platform 20 without any effort on his part. The platform 20 when fully extended thus works with the operator's natural leg action. Once the arc has been established, the amount of pressure required to keep the swing in motion appears to a rider to be negligible; some people even maintain a swinging motion with one leg crossed and only one foot on the platform 20.

Only a slightly greater pressure must be applied to the platform 20 to initiate swinging. Typically, the application of a slight pressure two or these times to the platform 20 during forward motion of the swing 13 is sufficient to propel it from a standstill to a large arc. Moreover, if braking is desired, slight pressure applied three or four times during reverse motion will bring the swing to a stop.

With the propulsion means provided by the apparatus 10, there is no need to lower the swing 13 sufficiently to enable a rider to push with his feet against the ground. Accordingly, the height of the swing seat can be varied to suit the preference of the individual rider. A minimum height for the seat is required, however, to allow the folding member 11 to retract. By way of example, this minimum height is approximately 13 inches for the swing 13 illustrated in the drawings. With this height, the platform 20 which itself measures approximately 10 inches in width clears the bottom edge of the swing 13. A swing 13 equipped with the apparatus 10 is especially attractive for the elderly who often experience difficultly in sitting upon and dismounting from swings which are low enough to be propelled by the rider's pushing his feet against the ground.

After a person is seated in the swing 13, he may rotate the platform 20 into a partially extended position by pulling outwardly on one of the chains 39, 39'. Alternately, he may push down with his hand on the rear edge of the platform 20 and lift his feet thereon. If the operator is wearing soft sole shoes that will grip, he may simply push down with his feet on the platform 20 to make it release and thereby commence swinging.

It will be understood that the invention is not limited to the embodiments disclosed, but is capable of capable of numerous rearrangements, modifications, and substitutions without departing from the scope of the invention.

What is claimed is:

1. In combination with a swing of the type wherein a seat is suspended by at least one pair of flexible members from an overhead structure, the improvement which comprises:

(a) a pair of support members, each of which is rigidly secured to the seat near the front side thereof and which extends generally downwardly therefrom;

(b) a folding member having a platform and a pair of arms, the opposite end portions of each arm being pivotally connected to the platform proximate the rear edge thereof and to one of the support members;

(c) means connected to the seat for biasing each arm to rotate upwardly about the pivotal joint between the arm and one of the support members, bringing the folding member into a retracted position in which a section of the front edge of the platform is disposed proximate the pivotal joint between one of said arms and one of the support members; the biasing means being overcome by the exertion of pressure on the platform, whereby the platform can be extended generally outwardly of the support members; and (d) means connected to the overhead structure for suspending the platform generally in front of the support members, the suspending means having a second pair of flexible members which are connected to the front portion of the platform, each of said second pair of flexible members being slack when the folding member is in said retracted position but being stretched taut as the platform is being extended and before the platform reaches its full travel, so that the application of foot pressure to the platform can easily set the swing, initially at rest, in motion.

2. The improvement according to claim 1 which further comprises means for limiting the rotation of the platform about said pivotal joints between the platform and the arms when the upper surfaces of the arms and of the platform are disposed generally parallel to each other, so that there is no movement between the platform and the arms as each arm moves about its pivotal joint with one of the support members as long as sufficient pressure is applied to the platform.

3. The improvement according to claim 1 wherein the biasing means further comprises at least one spring member, the lower end of the spring member being connected to the platform proximate the rear edge thereof and the upper end of the spring member being secured to the rear of the seat and wherein the support members are further characterized as being disposed generally rearwardly of the lower front edge of the seat, so that when the outer portions of the arms of the folding member are automatically rotated upwardly, the arms elevate the rear edge of the platform, dropping the front edge thereof generally downwardly and disposing the front edge of the platform generally behind the lower front edge of the seat, whereby the platform in said retracted position presents no obstacle to a rider during mounting and dismounting of the swing.

4. The improvement according to claim 3 wherein the biasing means further comprises means for adjusting the tension on the spring member to an individual rider's preference, the minimum tension on the spring member being such that the spring member will supply the force needed to make the platform retract when no pressure is applied thereto.

5. The improvement according to claim 1 wherein the suspending means further comprises at least one mounting bar mounted on the overhead structure, each mounting bar having means for attaching one of the second pair of flexible members thereto, the point of attachment of each of the second pair of flexible members to one of the mounting bars being disposed approximately vertically above one of said pivotal joints between an arm and one of the support members when the swing is at rest, so that any force component from the second pair of flexible members opposed to the biasing means is minimized when the folding member is retracted and a slight pressure applied generally downwardly to the platform when it is partially extended sets the swing in motion.

6. The improvement according to claim 1 wherein the suspending means further comprises at least one mounting bar attached to the overhead structure, each mounting bar having means for attaching one of the second pair of flexible members thereto, the point of attachment of each of the second pair of flexible members to one of the mounting bars being disposed generally in front of one of the first pair of flexible members supporting the seat; each of the second pair of flexible members being disposed, when the platform is fully extended, approximately parallel to a sloping line which connects the upper end, proximate said point of attachment, of one of the first pair of flexible members and the pivotal joint between one of the support members and one of the arms which is closer to said upper end, so that the upper surface of the platform remains, when the platform is fully extended, inclined at approximately the same angle to the horizon throughout the arc of the swing, whereby as the swing moves backwardly along its arc, the angle between the planes of the swing seat and of the platform when fully extended decreases in preparation for the application of foot pressure thereon during the forward movement of the swing, thereby providing nearly effortless swinging.

7. In combination with a swing of the type wherein a seat is suspended by at least one pair of flexible members from an overhead structure, the improvement which comprises:

(a) a pair of support members, each of which is rigidly attached to the seat near the front side thereof and which extends generally downwardly therefrom;

(b) a folding member having a platform disposed proximate the front edge thereof, the folding member being pivotally connected to the support members; the folding member, except when fully extended, forming a fold which opens downwardly; each pivotal joint between the folding member and one of the support members being spaced below the seat and disposed distal the apex angle of said fold; and (c) means attached to the overhead structure for suspending a second pair of flexible members which are connected to the front portion of the folding member, each of the second pair of flexible members hanging slack when the apex angle of said fold is a minimum but becoming taut as the angle is increased and before the folding member reaches its full travel, so that the application of foot pressure to the platform can easily set the swing, initially at rest, in motion.

8. The improvement according to claim 7 wherein the folding member is further characterized as exhibiting a double unfolding action in which the angle between at least one of the support members and a rear portion of the folding member pivotally connected to the support member is increased simultaneously as said apex angle is increased, the change in the distance between either of said pivotal joints and said front portion of the folding member to which the second pair of flexible members are connected as said apex angle is increased being much larger than the increase in the length of each of the second pair of flexible members as they become taut, so that only a slight pressure on the apex of said fold as the second pair of flexible members is being stretched taut is required to exert a sufficient force to propel the seat from rest to a gentle swinging motion.

9. The improvement according to claim 7 wherein the distance from said front portion of the folding member to either of the pivotal joints between one of the support members and the folding member changes as the second pair of flexible members is stretched taut, so that any force applied to the folding member so as to cause it both to unfold and to increase the tautness of the second pair of flexible members is transformed into a much larger force for propelling the swing forward along its arc.

10. The improvement according to claim 7 which further comprises means connected to the seat for biasing the folding member to rotate upwardly about the pivotal joints between the folding member and the support members, automatically bringing the folding member into a retracted position when foot pressure on the folding member is relaxed.

11. The improvement according to claim 10 wherein the biasing means further comprises at least one tension spring member, one end thereof being connected to the underside of the folding member and the other end of the spring being connected to the seat, and means for adjusting the tension on the spring so that the folding member is partially folded by the force of the spring when foot pressure on the folding member is relaxed, whereby the exertion of further foot pressure on the folding member to extend it outwardly during the forward movement of the swing will increase its arc.

12. The improvement according to claim 7 wherein the suspending means further comprises means for varying the point from which at least one of the second pair of flexible members is suspended, said point of suspension being disposed generally vertically above one of said pivotal joints between the folding member and one of the support members; the flexible member suspended from said point being situated proximate an imaginary sloping line which intersects the connection of said flexible member to the platform; the sloping line being disposed parallel to a line connecting the upper end, proximate said point of suspension, of one of the first pair of flexible members and the pivotal joint between the folding member and one of the support members which is closer to said upper end; the closer said flexible member coincides with said sloping line when the folding member is fully extended, the nearer the upper surface of the folding member remains, when unfolded, inclined at approximately the same angle to the horizon throughout the arc of the swing, so that as the swing moves backwardly along its arc, the angle between the planes of the swing seat and of the platform when fully extended decreases in preparation for the application of foot pressure thereon during the forward movement of the swing, thereby providing nearly effortless swinging.

13. In combination with a swing of the type wherein a seat is suspended by at least one pair of flexible members from an overhead structure, the improvement which comprises;

(a) a pair of support members, each of which is rigidly secured to the seat near the front side thereof and which extends generally downwardly therefrom;

(b) a folding member having a platform and a pair of arms, the opposite end portions of each arm being pivotally connected to the platform proximate the rear edge thereof and to one of the support members; and (c) means for biasing each arm to rotate upwardly about the pivotal joint between the arm and one of the support members, bringing the folding member into a retracted position; the biasing means being connected to the underside of the platform proximate the rear edge thereof and to the seat, so that when the outer portions of the arms of the folding member are rotated upwardly, the arms elevate the rear edge of the platform, dropping the front edge thereof generally downwardly and disposing said front edge of the platform generally beneath the lower front edge of the seat, whereby the platform in said retracted position presents no obstacle to a rider during mounting and dismounting of the swing.

14. The improvement according to claim 13 which further comprises means connected to the overhead structure for suspending the platform generally in front of the support members, the suspending means being connected to the front portion of the platform.

15. In combination with a swing of the type wherein a swing seat is suspended by one pair of flexible members from an overhead structure, the improvement which comprises:

(a) a pair of support members, each of which is rigidly secured to the swing seat near the front side thereof and which extends generally downwardly therefrom;

(b) a folding member having a platform and a pair of arms, the opposite end portions of each arm being pivotally connected to the platform proximate the rear edge thereof and to one of the support members; each of the arms and the platform, except when fully extended, forming a fold which opens downwardly; and (c) means for propelling the swing including a third flexible member connected to the overhead structure and to the front portion of the platform, the third flexible member hanging slack when the angle between the platform and one of the arms is a minimum but becoming taut as said angle is increased and well before the platform reaches its full travel, thereby utilizing a force created by the platform pulling on the third flexible member, when foot pressure is applied to extend the platform outwardly, to propel the swing seat.

* * * * *